US006471064B2

(12) United States Patent
Gordon

(10) Patent No.: US 6,471,064 B2
(45) Date of Patent: Oct. 29, 2002

(54) COMBINATION KEY RING, PILL BOX AND LIGHT

(76) Inventor: John B. Gordon, 50511 Galaxy Dr., Granger, IN (US) 46530

( * ) Notice: Subject to any disclaimer, the term of this patent is extended or adjusted under 35 U.S.C. 154(b) by 1 day.

(21) Appl. No.: 09/735,979

(22) Filed: Dec. 13, 2000

(65) Prior Publication Data

US 2002/0020635 A1 Feb. 21, 2002

Related U.S. Application Data

(60) Provisional application No. 60/172,472, filed on Dec. 17, 1999.

(51) Int. Cl.[7] ..... B65D 83/04
(52) U.S. Cl. ..... 206/534; 206/538; 362/116
(58) Field of Search ..... 206/38.1, 534, 206/538, 540; 362/116, 154, 253

(56) References Cited

U.S. PATENT DOCUMENTS

| | | | | |
|---|---|---|---|---|
| 1,280,300 A | | 10/1918 | Recker | |
| 4,153,927 A | | 5/1979 | Owens | |
| 4,223,801 A | | 9/1980 | Carlson | |
| 4,305,118 A | | 12/1981 | Paquette | |
| 4,314,317 A | | 2/1982 | Robson | |
| 4,526,474 A | | 7/1985 | Simon | |
| 4,765,459 A | | 8/1988 | Edwards | |
| 4,864,474 A | | 9/1989 | Maglita | |
| 4,888,667 A | | 12/1989 | Hwang | |
| 4,914,748 A | | 4/1990 | Schlotter | |
| 4,936,444 A | | 6/1990 | Yamaki | |
| 5,008,784 A | | 4/1991 | Wang | |
| 5,086,377 A | | 2/1992 | Roberts | |
| 5,573,109 A | * | 11/1996 | Isacson | 206/38.1 |
| 5,950,816 A | * | 9/1999 | Reid | 206/38.1 |
| 6,119,864 A | * | 9/2000 | Kessler et al. | 206/704 |

FOREIGN PATENT DOCUMENTS

| | | |
|---|---|---|
| BE | 498051 | 12/1951 |
| CA | 989369 | 5/1976 |
| GB | 402164 | 11/1933 |
| GB | 2227825 | 8/1990 |

* cited by examiner

*Primary Examiner*—Shian Luong
(74) *Attorney, Agent, or Firm*—James D. Hall; Ken C. Decker

(57) ABSTRACT

The device of this invention is a combination key ring, pill box and light which includes a case containing a compartment for medicine and a compartment for a light and battery.

4 Claims, 2 Drawing Sheets

COMBINATION KEY RING, PILL BOX AND LIGHT

CROSS REFERENCE TO RELATED APPLICATIONS

This is a continuation of provisional application Ser. No. 60/172,472, filed Dec. 17, 1999.

SUMMARY OF THE INVENTION

This invention relates to a key ring and will have specific application to a key ring which incorporates a pill box and a light.

For medical reasons, it has been found to be advantageous to have at one's immediate access certain forms of medication, such as aspirin for heart attacks and nitroglycerin tablets for angina attacks. Additionally, antidotes for insect stings needs also to be made readily available to people extremely allergic to insect bites such as bee and wasp stings. Containers for such medication are usually separately carried items which can be easily lost, misplaced or forgotten.

In this invention, a medication holder is combined with a key ring and a light. The combination key ring, medication or pill box, and light is of a compact design which can be conveniently carried in one's pocket or purse. By including a predominately used key, such as a car or house key, the ring, box, and light combination device will always be carried by the user and thus conveniently available if and when needed.

Accordingly, it is an object of this invention to provide a medication case which is of compact design used in combination with a key ring.

It is another object of this invention to provide a combination key ring, medication or pill box and light device which is of economical design and compact size.

Still another object of this invention is to provide a medication or pill box which incorporates a key ring and which may also include a light and which is of a simplified use.

Other objects of this invention will become apparent upon a reading of the following description.

DETAILED DESCRIPTION OF THE PREFERRED EMBODIMENT

The preferred embodiment illustrated is not intended to be exhaustive or to limit the invention to the precise form disclosed. Rather, it is chosen and described to better explain the principles of the invention and to enable one having an ordinary skill in the art to utilize the invention.

Figure 1:
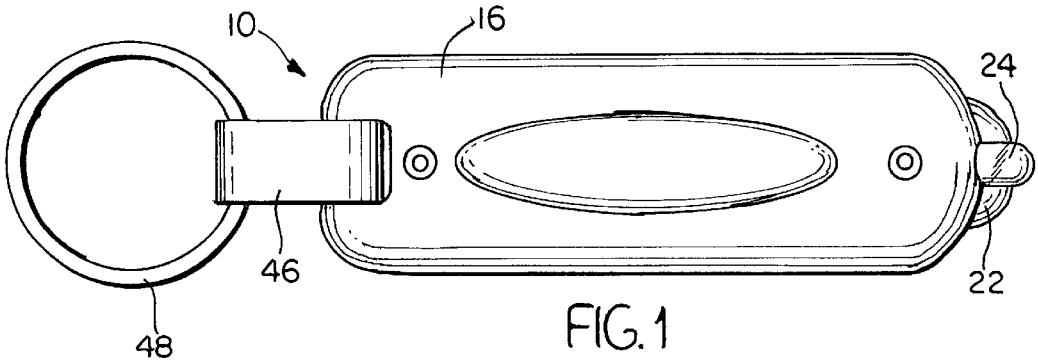
FIG. 1 is a bottom plan view of the combination key ring, medication or pill box, and light of this invention.
Figure 2:
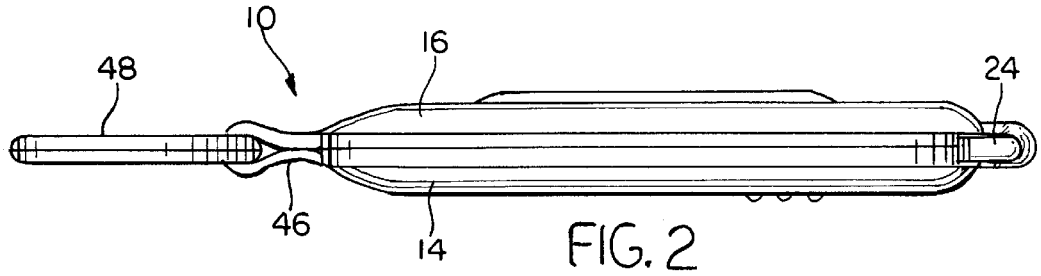
FIG. 2 is a side view of the device of this invention as oriented in FIG. 1.
Figure 3:
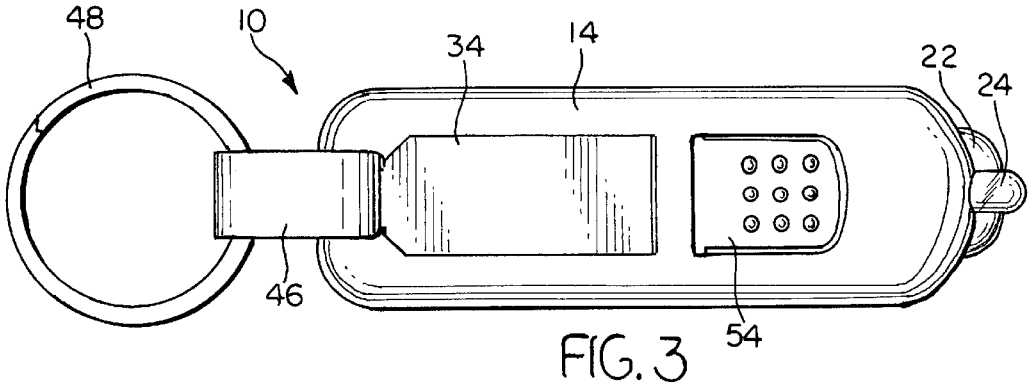
FIG. 3 is a top plan view of the device.
Figure 4:
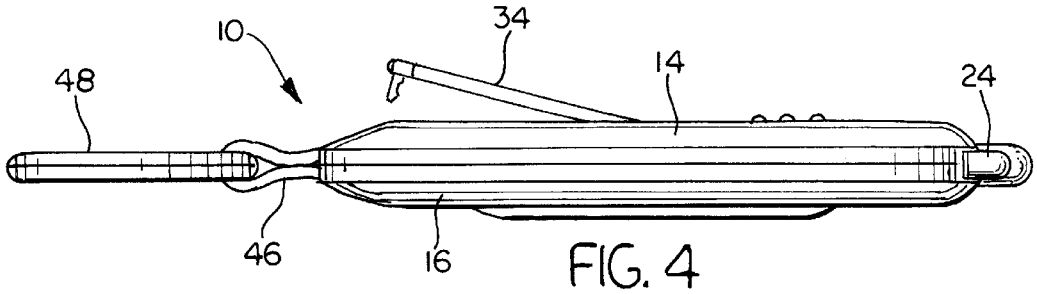
FIG. 4 is a side view of the device as oriented in FIG. 3 showing the door of the medication compartment being partially open.
Figure 6:
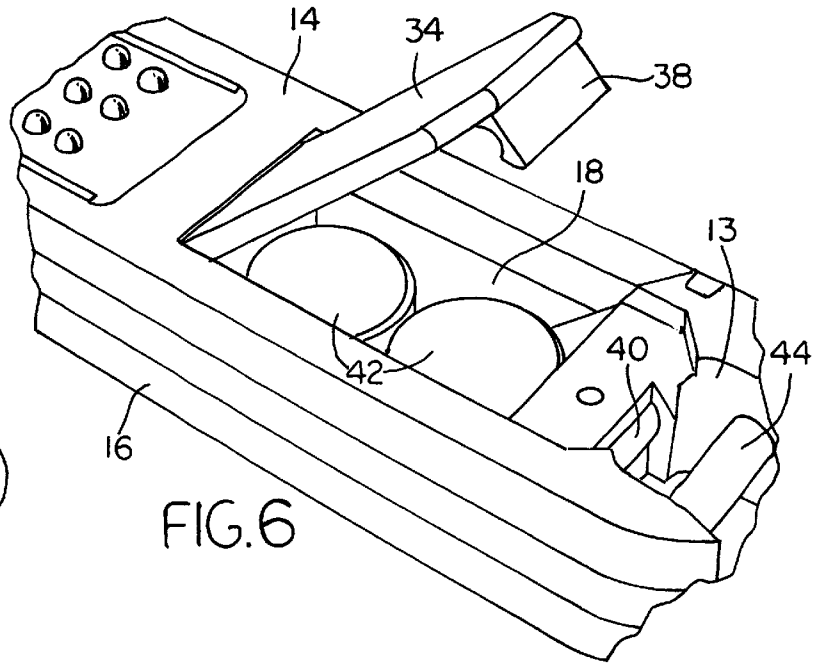
FIG. 6 is an enlarged fragmentary view of the device showing the key ring removed and with the medication compartment door partially open.
Figure 5:
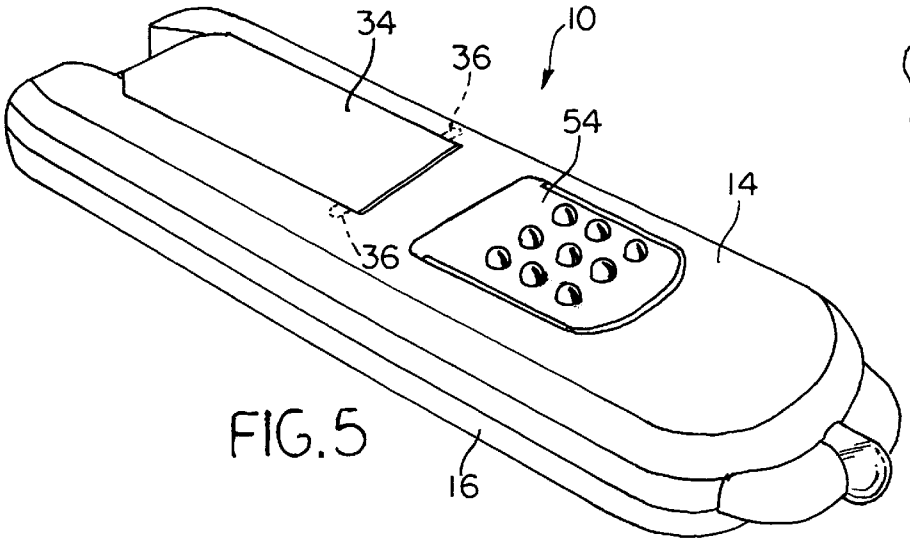
FIG. 5 is a perspective view of the device with the key ring removed for illustrative purposes and is seen as from the top.
Figure 7:
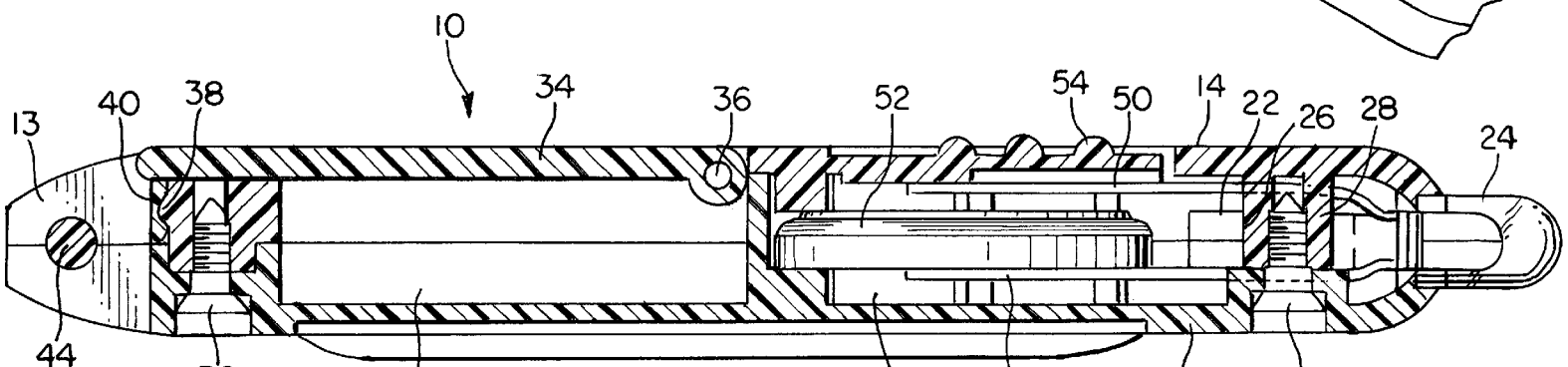
FIG. 7 is a longitudinal sectional view of the device as shown in FIG. 5.

The device 10 shown in the Figures includes a case or body 12 which is preferably formed of a plastic molded material into adjoining or claim shell-like parts 14 and 16. Case parts 14 and 16 are joined together by screws 30, 32. Formed within case 12 is a medicine compartment 18 and an adjacent battery compartment 20. A collar 22 extends about the light bulb 24 and includes a center opening 26. A post 28 forming a component of case part 14 protrudes through opening 26 in collar 22. Screw 30 extends through case part 16 and into post 28 of case part 14 serving not only to connect the parts together but also to retain collar 22 and its captured bulb 24 in location in device 10. A lid 34 is hinged by oppositely extending pintles 36 to case part 16. Pintles 36 are snap fitted into receiving openings or bores in case part 16 and enable lid 34 to be pivoted between an open position as partly shown in FIG. 6 and a fully closed position as shown in FIG. 7. When lid 34 is in its open position, compartment 18 is exposed. Lid 34 includes a depending tongue 38 which is grooved and which is snap fitted over a protruding rib 40 formed in the slotted end portion 13 of case 12. Tongue 38 has a limited amount of flexure which allows the lid to be released from rib 40 when the lid is opened and to be snap fitted over rib 40 in its closed and secured position shown in FIG. 7.

Slotted end 13 of case 12 includes a transverse dowel 44. A connecting sleeve 46, preferably formed of a flexible plastic or leather material extends around dowel 44 and a split key ring 48.

Bulb 24 includes a pair of spaced electrical leads 50. Leads 50 extend into battery compartment 20 and between which is placed a battery 52 also housed within the battery compartment. One bulb lead 50 is in constant contact with one terminal side of battery 52. The other lead 50 of bulb 24 is slightly spaced from the other terminal side of the battery and underlies a flexible, depressable switch component or tab 54. Tab 54 is formed as in integral part of case compartment 14 in a cantilevered fashion. When tab 54 is depressed, it forces the underlying bulb lead 50 into contact with the underlying battery terminal which completes the circuit to the bulb, causing the bulb to light. Upon release of tab 54, it springs back into its normal undepressed mode allowing the flexible lead 50 to spring away from contact with the battery, extinguishing the light in bulb 24. Therefore as tab 54 is depressed or released by the user of device 10, light 24 will be lit or extinguished.

In medicine compartment 18, there may be carried one or two aspirin, a plurality of nitroglycerin tablets, a small vial of antidote for insect stings or other emergency medication 42. In this manner, the medication is readily available to the carrier of device 10. The house or vehicle key attached to key ring 48 of device 10 will be readily available to the user for usage. Bulb 24 may serve as an illuminator for many purposes such as finding the necessary key slot in the vehicle or door.

It is to be understood that the above invention is not to be limited to the details given but may be modified within the impended claim.

What I claimed is:

1. A combination key ring and medication device comprising an elongated case having first and second opposite end portions, a light bulb at said first end portion, said second end portion defining a slot and including a transverse dowel extending across said slot, said case including a medicine compartment adjacent said second end portion and a battery compartment adjacent said first end portion, said battery compartment for providing means to illuminate said light bulb, said medicine compartment having an opening for exposing the interior of the medicine compartment, a lid hinged to said case between said battery compartment and said medicine compartment for pivotal movement relative to the case between an open position exposing the interior of said medicine compartment and a closed position covering said medicine compartment opening, said lid including a depending tongue, said lid tongue extending into said second end portion slot in releasable snap-fitting engagement with said case when the lid is in its closed position, and a key ring attached to said dowel.

2. The combination of claim 1 wherein said lid tongue is located between said dowel and said case when said lid is in its closed position.

3. The combination of claim 1 wherein said case includes opposing shell-like parts, a collar extending about said light bulb and having a central opening, one of said case parts including a post, said post extending into said collar opening, a fastener extending through the other of said case parts and into said post to secure the case parts together and to retain said light bulb.

4. The combination of claim 3 and a depressable tap carried by said case over said battery compartment, said tab when depressed for causing illumination of said light bulb through the actuation of said battery compartment means.

* * * * *